US007624935B2

(12) United States Patent
Nelson et al.

(10) Patent No.: US 7,624,935 B2
(45) Date of Patent: Dec. 1, 2009

(54) DISTRIBUTOR PLATE AND DIFFUSER PLATE ON SLEEVED SHAFT

(75) Inventors: Craig Nelson, Walla Walla, WA (US); George L. Sesser, Walla Walla, WA (US); Patrick T. Barry, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 259 days.

(21) Appl. No.: 11/513,011

(22) Filed: Aug. 31, 2006

(65) Prior Publication Data

US 2008/0054093 A1 Mar. 6, 2008

(51) Int. Cl.
*B05B 3/06* (2006.01)

(52) U.S. Cl. ..... 239/252; 239/222.11; 239/231; 239/243; 239/245; 239/261; 239/505

(58) Field of Classification Search ..... 239/220, 239/222.11, 222.17, 222.21, 223, 224, 231, 239/133, 237, 243, 244, 245, 252, 259, 263, 239/264, 381–383, 681, 682, 33, 232, 236, 239/251, 255, 256, 261, 502, 505, 507, 508, 239/518, 524

See application file for complete search history.

(56) References Cited

U.S. PATENT DOCUMENTS

| | | | | | |
|---|---|---|---|---|---|
| 458,607 | A * | 9/1891 | Weiss | ..... | 239/222.17 |
| 3,602,431 | A * | 8/1971 | Lockwood | ..... | 239/381 |
| 4,796,811 | A * | 1/1989 | Davisson | ..... | 239/222.17 |
| 4,805,838 | A * | 2/1989 | Greenberg | ..... | 239/222.17 |
| 4,836,449 | A | 6/1989 | Hunter | | |
| 4,836,450 | A | 6/1989 | Hunter | | |
| 4,944,456 | A | 7/1990 | Zakai | | |
| 5,007,586 | A * | 4/1991 | Cohen | ..... | 239/222.17 |
| 5,192,024 | A | 3/1993 | Blee | | |
| 5,372,307 | A | 12/1994 | Sesser | | |
| 5,671,886 | A | 9/1997 | Sesser | | |
| 5,718,381 | A * | 2/1998 | Katzer et al. | ..... | 239/222.11 |
| 6,494,384 | B1 * | 12/2002 | Meyer | ..... | 239/222.11 |
| 6,899,287 | B2 * | 5/2005 | Pinch et al. | ..... | 239/380 |
| 7,086,608 | B2 * | 8/2006 | Perkins | ..... | 239/222.17 |
| 7,143,957 | B2 * | 12/2006 | Nelson | ..... | 239/222.21 |

* cited by examiner

*Primary Examiner*—Len Tran
*Assistant Examiner*—Jason J Boeckmann
(74) *Attorney, Agent, or Firm*—Nixon & Vanderhye, P.C.

(57) ABSTRACT

A water distribution plate and diffuser plate assembly for distributing a stream emitted from a sprinkler nozzle includes: a nonrotatable shaft having one end attached to a sprinkler component and an opposite end supporting first and second plates in axially spaced relationship for rotation about the shaft independent of one another. The first plate is axially adjacent the nozzle and formed with plural water distribution grooves shaped and arranged to divide a single primary stream emitted from the nozzle into a plurality of secondary streams. The second plate is downstream of the first plate and formed with plural diffuser elements arranged to be struck by at least some of the secondary streams exiting the first plate. The speed of rotation of one or both plates is slowed by viscous damping.

9 Claims, 9 Drawing Sheets

DISTRIBUTOR PLATE AND DIFFUSER PLATE ON SLEEVED SHAFT

BACKGROUND OF THE INVENTION

This invention relates to rotary sprinklers and, more specifically, to a rotary sprinkler having a stream diffuser driven in random fashion by a stream emitted from a fixed nozzle and redirected by a grooved water distribution plate in the form of plural secondary streams, some of which strike the diffuser.

Stream interrupters or diffusers per se are utilized for a variety of reasons and representative examples may be found in U.S. Pat. Nos. 5,192,024; 4,836,450; 4,836,449; 4,375,513; and 3,727,842.

One reason for providing stream interrupters or diffusers is to enhance the uniformity of the sprinkling pattern. When irrigating large areas, the sprinklers are spaced as far apart as possible in order to minimize system costs. To achieve an even distribution of water at wide sprinkler spacings requires sprinklers that simultaneously throw the water a long distance and produce a pattern that "stacks up" evenly when overlapped with adjacent sprinkler patterns. These requirements are achieved to some degree with a single concentrated stream of water shooting at a relatively high trajectory angle (approximately 24° from horizontal), but streams of this type produce a nonuniform "donut pattern". Interrupting a single concentrated stream, by fanning some of it vertically downwardly, produces a more even pattern but also reduces the radius of throw.

Proposed solutions to the above problem may be found in commonly owned U.S. Pat. Nos. 5,372,307 and 5,671,886. The solutions disclosed in these patents involve intermittently interrupting the stream so that at times, the stream is undisturbed for maximum radius of throw, while at other times, it is fanned to even out the pattern. In both of the above-identified commonly owned patents, the rotational speed of the water distribution plate is slowed by a viscous fluid brake to achieve both maximum throw and maximum stream integrity.

There remains a need, however, for an even more efficient stream interrupter or diffuser configuration to achieve more uniform wetted pattern areas.

BRIEF DESCRIPTION OF THE INVENTION

In the exemplary embodiments of this invention, a water distribution plate and an axially spaced stream diffuser plate are mounted for rotation on a solid shaft and a hollow sleeve, respectively, surrounding the shaft. Rotation of the water distribution plate causes rotation of the diffuser plate by reason of a viscous fluid coupling between the shaft and the sleeve. Viscous damping also slows the respective rates of rotation of the two plates.

In one exemplary embodiment, the shaft is fixed and extends upwardly through the nozzle of a sprinkler head or body. The shaft supports the water distribution plate and diffuser plate downstream of an arcuate or full circle stream emitted from the nozzle. The water distribution plate has a generally truncated cone shape, and is formed with a plurality of grooves that are slightly curved in a circumferential direction so that when the stream emitted from the nozzle impinges on the grooves, the water distribution plate is caused to rotate about the shaft. A first stator component is fixed to the shaft and located within a sealed first chamber in the water distribution plate. The chamber is at least partially filled with a viscous fluid that causes the rate of rotation of the water distribution plate to be significantly slowed in comparison to an unbraked rate of rotation. Downstream of the water distribution plate, the diffuser plate is mounted on a sleeve surrounding a portion of the shaft. A second stator component is fixed to the sleeve in a second sealed chamber in the water distribution plate that is also at least partially filled with viscous fluid. The diffuser plate is provided with a plurality of diffuser elements projecting downwardly from a peripheral edge of the lower surface of the diffuser.

The lower end of the sleeve terminates adjacent the first stator and the upper end of the sleeve terminates within the body of the diffuser plate, with viscous fluid in the annular space between the sleeve and the shaft. The shaft is supported by bearings on either side of both stators, and by a bearing in the diffuser body, above the sleeve. Thus, the shaft extends from the sprinkler body, through both the distributor plate and the diffuser plate, while the sleeve, which is of shorter axial length, extends only between the distributor plate and the diffuser plate. Seals and retainer rings are used to keep the bearings in place and to prevent leakage of viscous fluid along the shaft.

In use, the stream emitted from the nozzle impinges on the water distribution or first plate provided with the drive grooves, causing it to rotate about the shaft. The rotation of the first plate is dampened or slowed by the first viscous brake mechanism within the distributor plate and by the viscous coupling between the shaft and the sleeve. After the secondary streams leave the distributor plate, individual random ones of the secondary streams impinge on the diffuser elements on the diffuser plate. The diffuser plate does not need to be positively driven, however, because of the shearing action of the silicone fluid between the hollow shaft and the solid shaft. In other words, a rotating action of either plate will cause the other plate to rotate because of this viscous fluid coupling. Not all of the secondary streams are diffused by the diffuser plate, and the differential rotation between the two plates insures uniformity of the wetted pattern area. To enhance the rotation of the diffuser plate, surfaces on the diffuser elements may be shaped as vane surfaces to drive the plate when impinged upon by the secondary streams from the water distribution plate.

In a second exemplary embodiment, the water distribution plate and diffuser plate are again mounted on a single shaft, but the shaft is supported for rotation within a sprinkler cap assembly or housing that is in turn supported on the sprinkler body downstream of the nozzle. Thus, in this embodiment, the shaft does not project upwardly through the sprinkler nozzle.

More specifically, the water distribution plate is fixed at one end of the shaft, for rotation with the shaft when a stream emitted from the nozzle impinges on drive grooves formed in the plate. The opposite end of the shaft is seated in a blind bore formed in a remote end of a housing component downstream of the nozzle. A first rotor is fixed to the shaft at the remote end of the housing, with a first housing bearing sealing a first chamber in which the first rotor is received. The chamber is at least partially filled with a viscous fluid and rotation of the distributor plate is dampened or slowed by viscous shearing of the fluid between the rotor and the chamber wall.

The diffuser plate is supported by a sleeve, adjacent the water distribution plate, and telescoped over the shaft. Thus, the shaft passes through a bearing supported in the diffuser plate, and the sleeve is supported by first and second housing bearings. A second rotor is fixed to the sleeve and the first and second housing bearings form the ends of a second chamber for the second rotor. The second chamber is also at least partially filled with viscous fluid. The diffuser plate in this embodiment is formed with curved grooves with raised flats between the grooves. In use, this second embodiment operates in a manner generally similar to the first-described embodiment.

Accordingly, in a first aspect, the invention relates to a water distribution and diffuser assembly for a sprinkler comprising: a shaft; a distribution plate mounted on the shaft for rotation relative to the shaft; and wherein the shaft passes through and extends beyond the distribution plate; a sleeve telescoped over at least a portion of the shaft; a diffuser plate fixed to the sleeve downstream of the distribution plate; and wherein the shaft passes through the sleeve, with the shaft supporting bearings in the distribution plate and on the diffuser plate.

In another aspect, the invention relates to a sprinkler comprising a sprinkler body incorporating a nozzle, a fixed shaft extending downstream of the nozzle and supporting a water distribution plate for rotation relative to the shaft, the water distribution plate formed with drive grooves adapted to receive a stream from the nozzle and to create secondary streams within the drive grooves causing rotation of the water distribution plate; a sleeve received over the shaft for rotation relative to the shaft and relative to the water distribution plate, the sleeve mounting a diffuser plate for rotation with the sleeve, the diffuser plate having diffuser elements adapted to be struck by at least some of the secondary streams; and wherein viscous fluid is present in an annular space between the shaft and the sleeve.

In still another aspect, the invention relates to a sprinkler comprising a nozzle adapted to emit a stream to atmosphere, a water distribution plate and diffuser plate assembly located downstream of the nozzle, the assembly comprising a shaft mounted in a housing for rotation relative to the housing; a water distribution plate fixed to one end of the shaft, the water distribution plate formed with at least one drive groove adapted to receive the stream; a sleeve received over a portion of the shaft, the sleeve mounting a diffuser plate adjacent the water distribution plate, at one end of the sleeve; the shaft and the sleeve supported by plural bearings enabling the sleeve and the diffuser plate to rotate relative to the water distribution plate and the shaft; and wherein at least one of the shaft and the sleeve mount a rotor located in a chamber at least partially filled with viscous fluid.

The invention will now be described in detail in connection with the drawings identified below.

DETAILED DESCRIPTION OF THE INVENTION

Figure 1:
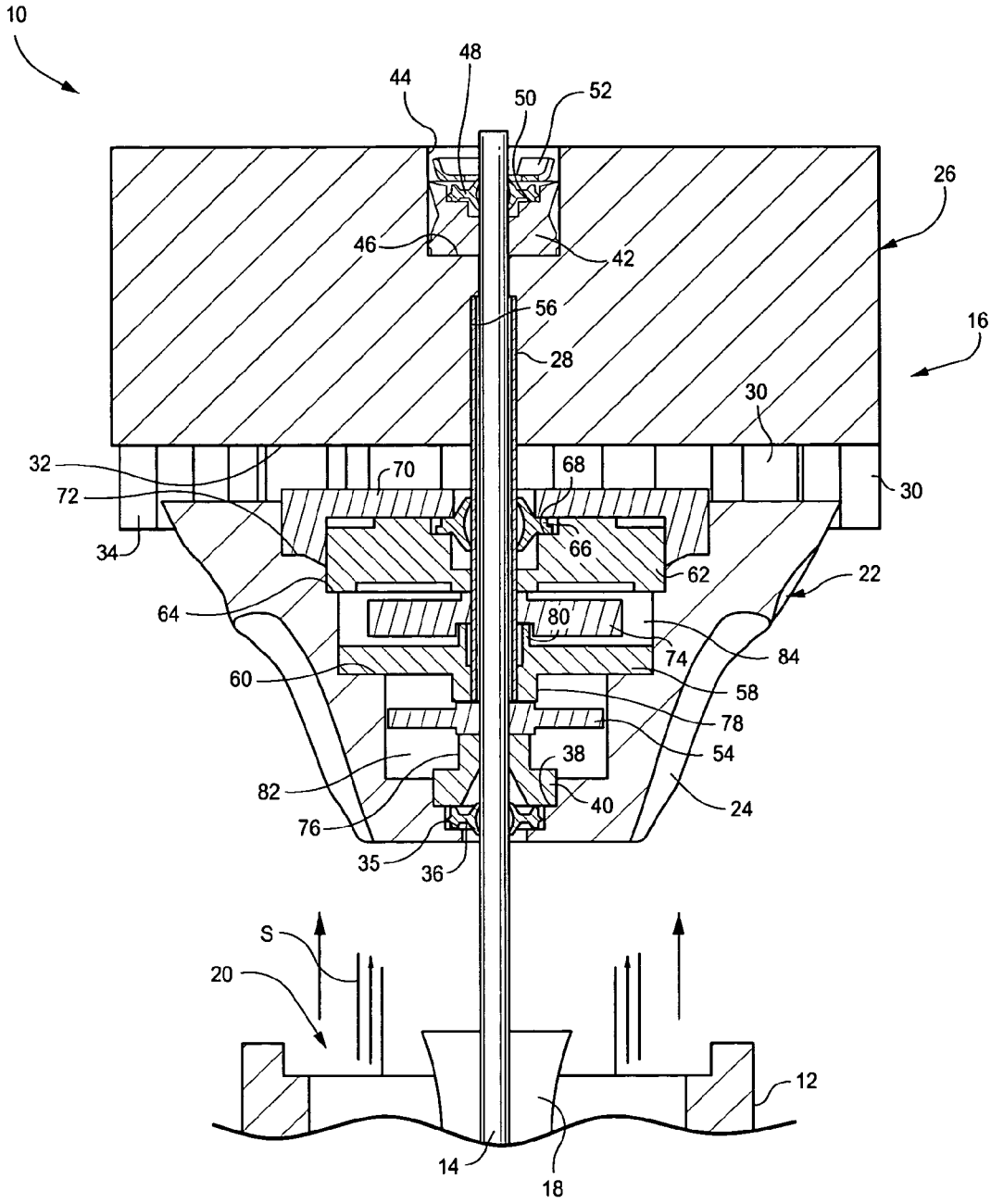
FIG. 1 is a partial cross section through a rotary sprinkler incorporating a water distribution plate and diffuser plate in accordance with a first exemplary embodiment of the invention.

Referring to FIGS. 1-5, a sprinkler head is partially shown at 10 and incorporates a schematically depicted nozzle 12 supporting one end of a shaft 14. The shaft 14 (see also FIGS. 2 and 3) extends out of the sprinkler head, in a downstream direction, and supports a water distribution plate and diffuser plate assembly 16 for impingement by a stream S emitted from the nozzle. A stream deflector 18 is fixed to the shaft 14 and cooperates to define the nozzle orifice 20. The deflector guides an arcuate (or round) stream onto the water distribution plate 22 formed with a plurality of grooves 24 shaped to divide the single vertically-oriented arcuate or full 3600 stream emitted from the nozzle 12 into a plurality of secondary streams or stream components, and to redirect those stream components in a generally radial direction. Grooves 24 are also curved slightly in a circumferential direction (see FIG. 5) such that the water distribution plate 22 is caused to rotate about the shaft 14 as a result of the plurality of stream components acting on the interior walls of the grooves. Such water distribution plates are well-known in the art.

A diffuser plate component 26 of the assembly 16 is supported on a sleeve 28 that is telescoped over the shaft 14. As explained in further detail below, the diffuser plate 26 and sleeve 28 are able to rotate relative to the fixed shaft 14 and independently of the water distribution plate 22. The diffuser plate 26 is provided with a plurality of diffuser elements 30, projecting below a lower surface 32 of the plate 26, and arranged about a peripheral edge thereof. Each diffuser element may be provided with a curved vane surface 34 (see especially FIG. 5) such that when secondary streams from the distribution plate impinge on the diffusion plate, the latter is caused to rotate. As described further below, rotation of the water distribution plate 22 is substantially uniform while rotation of the diffuser plate 26 is intermittent and random.

Figure 2:
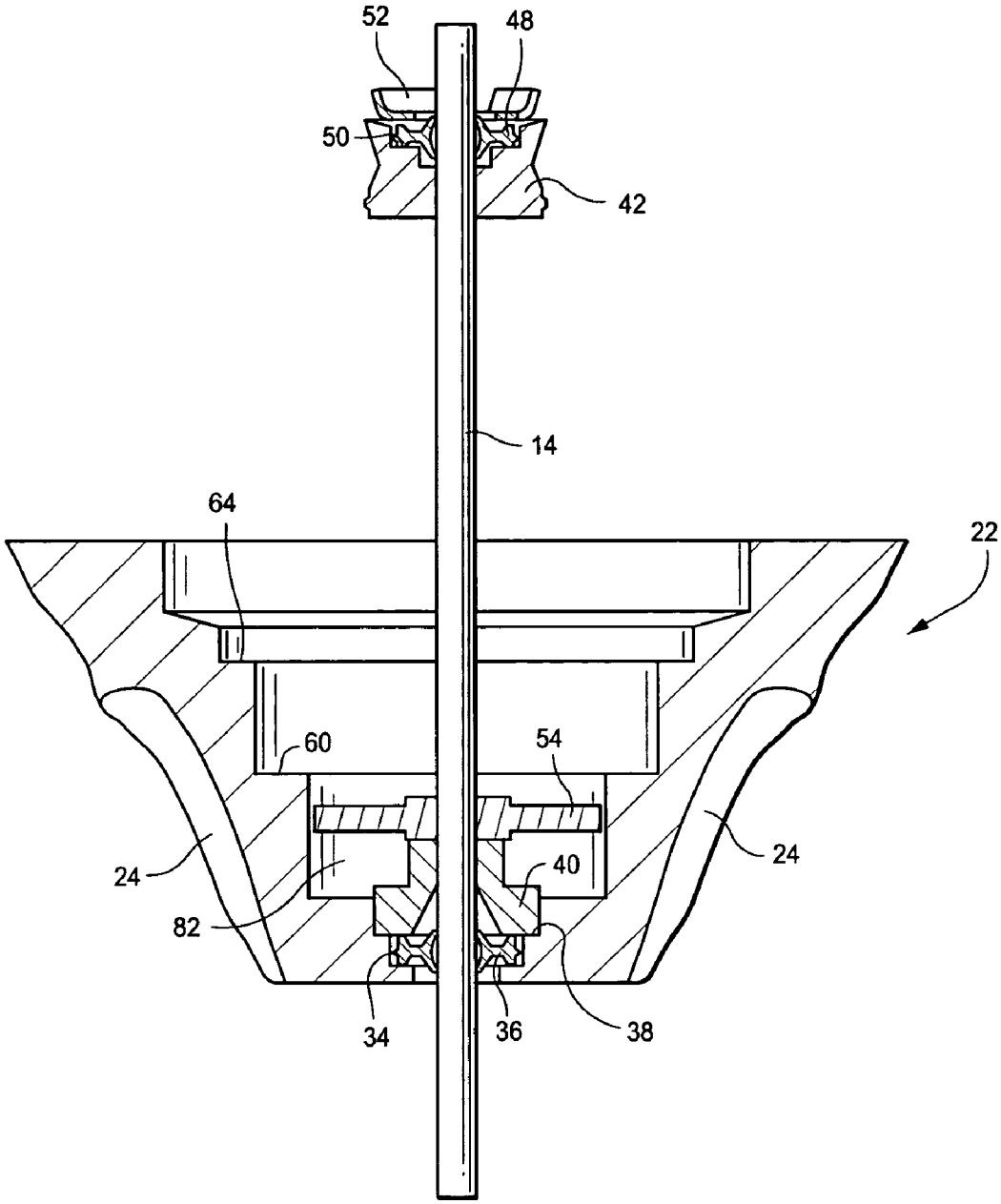
FIG. 2 is a section similar to FIG. 1 but showing only shaft, water distribution plate and first stator component.
Figure 3:
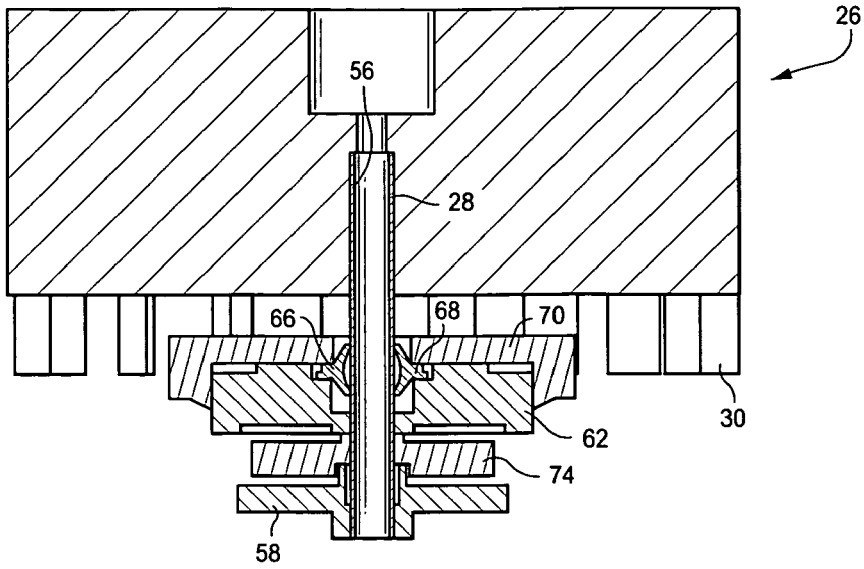
FIG. 3 is a section similar to FIG. 1 but showing only the sleeve, diffuser plate, and second stator component.
Figure 4:
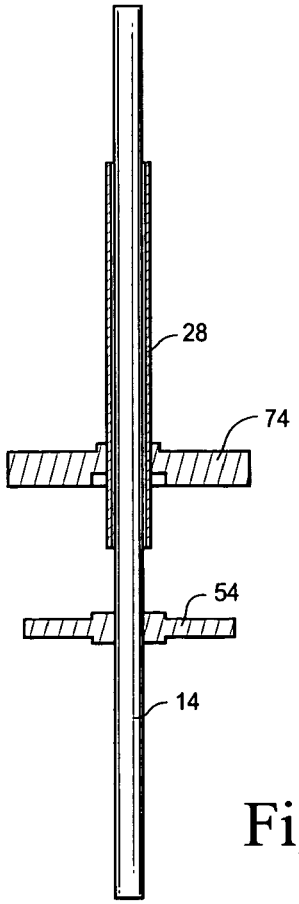
FIG. 4 is a front elevation of a shaft provided with a pair of stator elements as incorporated in the sprinkler shown in FIG. 1.
Figure 5:
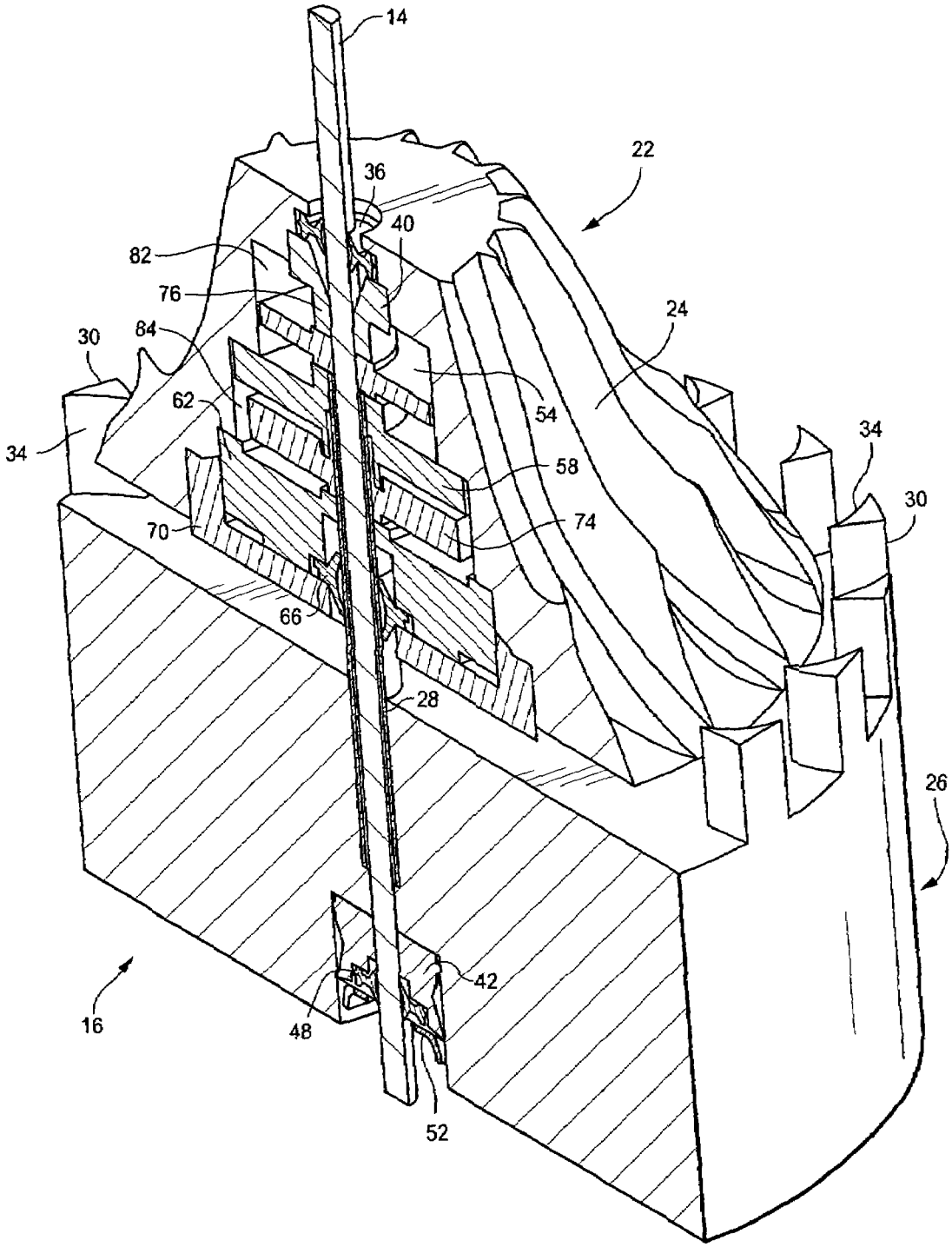
FIG. 5 is a sectioned perspective view of the water distribution and diffuser plates shown in FIG. 1 but inverted relative to the orientation in FIG. 1.

The mounting and support arrangement for the water distribution plate 22 and the diffuser plate 26 of the assembly 16 is best understood by considering each separately in connection with FIGS. 2 and 3.

With particular reference to FIG. 2, the water distribution plate 22 is bored and counterbored to essentially hollow out the plate, with a series of annular shoulders at increasing radii in a downstream direction from a center axis defined by the shaft 14. More specifically, a first shoulder 35 axially adjacent the nozzle 12 supports a first conventional double-lip seal 36 that engages the shaft 14. A second shoulder 38 supports a first distributor plate bearing 40 that supports the shaft at a location proximate the nozzle 12. The opposite end of the shaft is supported by a second distributor plate bearing 42 that is, in turn, press-fit into a counterbore 44 (FIG. 1) in the plate 26 and supported on a shoulder 46 formed in the plate. A flexible double-lip seal 48 is supported on a shoulder 50 formed in the bearing 42, and a retainer 52 holds the seal in place.

A fixed (or first) stator 54 is fixed to the shaft 14 at a location adjacent the bearing 40 and forms part of a first viscous brake mechanism designed to slow rotation of the distribution plate as explained further below.

Turning to FIG. 3, the diffuser plate 26 is press-fit on the sleeve 28, the latter extending into a counterbore 56 in the diffuser plate, and terminating at a location below the bearing 42 (FIG. 2). The sleeve 28 is telescoped over the shaft 14 (see also FIGS. 1 and 4), and the opposite end of the sleeve 28 is seated in a diffuser plate bearing 58 supported on a shoulder 60 (FIGS. 1 and 2) in the distribution plate 22. The sleeve 28 is also supported by a second diffuser plate bearing 62 (FIGS. 1 and 3) seated on a shoulder 64 in the distribution plate 22. Bearing 62 supports a flexible double-lip seal 66 on a bearing shoulder 68, and a retainer disc 70 is press-fit over the shaft and into the distribution plate 22 until it engages shoulder 72. A second stator disk or stator 74 is fixed to the sleeve 28 between bearings 58 and 62. In this regard, note that bearings 40 and 58 have respective sleeve portions 76, 78 that abut the stator 54. Similarly, a second sleeve portion 80 on the opposite side of bearing 58 and a lower end of the bearing 62 engage opposite sides of the second stator 74. Thus, the retainer 70 with the help of fixed stators 54 and 74, hold the bearings 40, 58 and 62 in place within the distributor plate 22.

As best seen in FIG. 1, the water distribution plate stator (or first stator) 54 is located in a chamber 82 with ends of the chamber closed by bearings 40 and 58. Chamber 82 is at least partially filled with a silicone or other suitable viscous fluid. It will be understood that the speed of rotation of the distribution plate 22 will be slowed by the fluid shearing action in chamber 82 resulting from the rotation of the plate 22 relative to the fixed stator 54.

Similarly, a second chamber 84 is closed at opposite ends by bearings 58 and 62. The diffuser plate (or second) stator 74 is located in the chamber 84, and the latter is also at least partially filled with a viscous fluid. In this way, rotation of the diffuser plate 26 which is fixed to the sleeve 28 is slowed by the viscous shearing in the chamber 84.

In use, a stream of water emitted from the nozzle orifice 20 will engage the grooves 24, and break up into plural secondary streams. The curved grooves will cause the plate 22 to rotate but the speed of rotation will be slowed by reason of viscous shearing of fluid between the shaft 14 and sleeve 28, as explained above.

Only some of the plural streams leaving the grooves 24 will strike vane surfaces 34 of the diffuser elements 30, thus causing the diffuser plate to rotate in a sporadic and random pattern (this is because the two plates rotate at different speeds). It should also be noted that the diffuser element vane surfaces may or may not be curved so as to cause rotation of the diffuser plate 26 when struck by secondary streams. In other words, viscous fluid present between the shaft 14 and the sleeve 28 establishing a fluid coupling therebetween, such that rotation of the distribution plate 22 will cause some degree of rotation of the diffuser plate 26. Nevertheless, rotation of the plate 26 may be enhanced by curving the vane surfaces 34.

Figure 6:
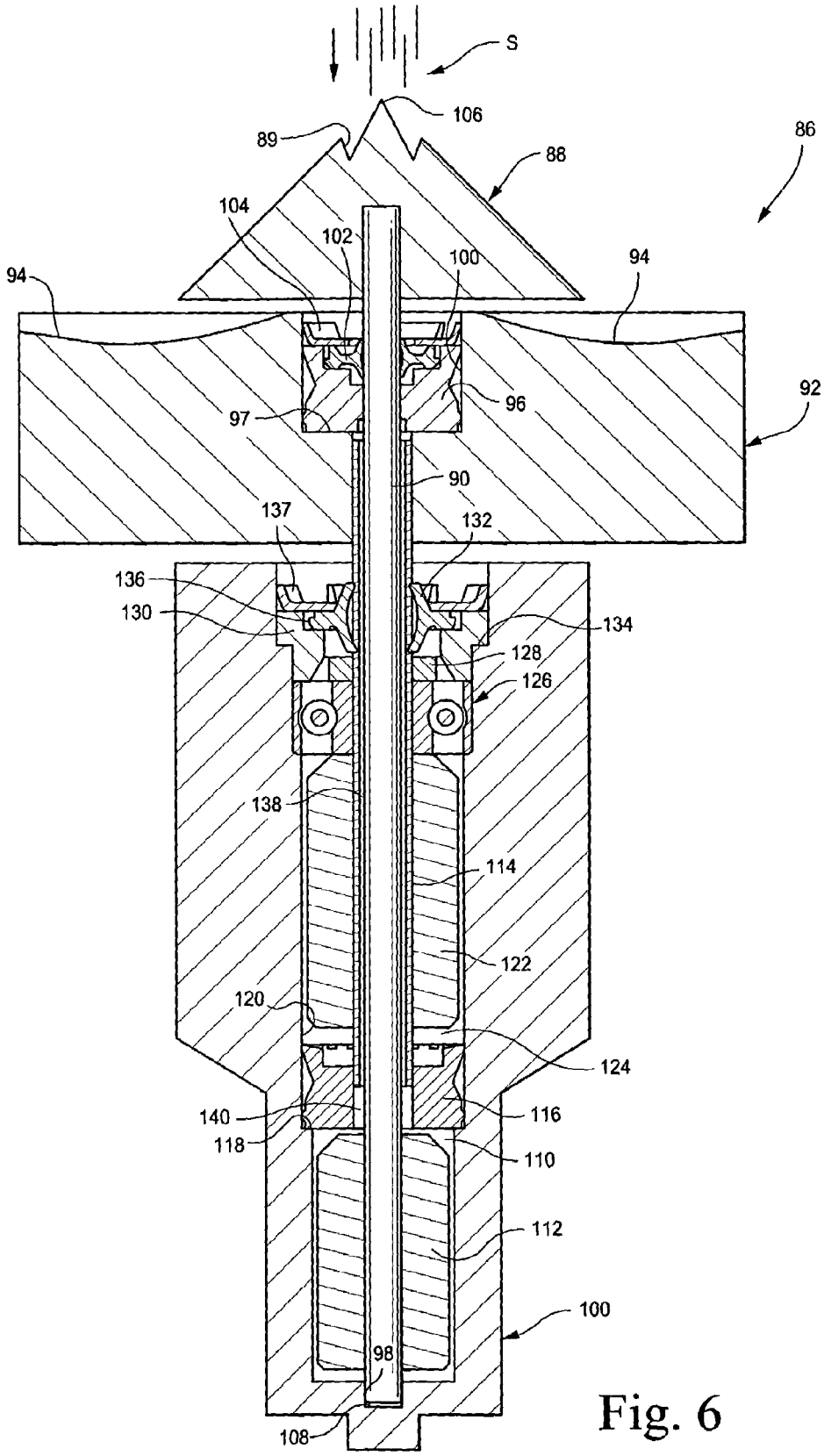
FIG. 6 is a partial cross section through a rotary sprinkler in accordance with a second exemplary embodiment of the invention.
Figure 7:
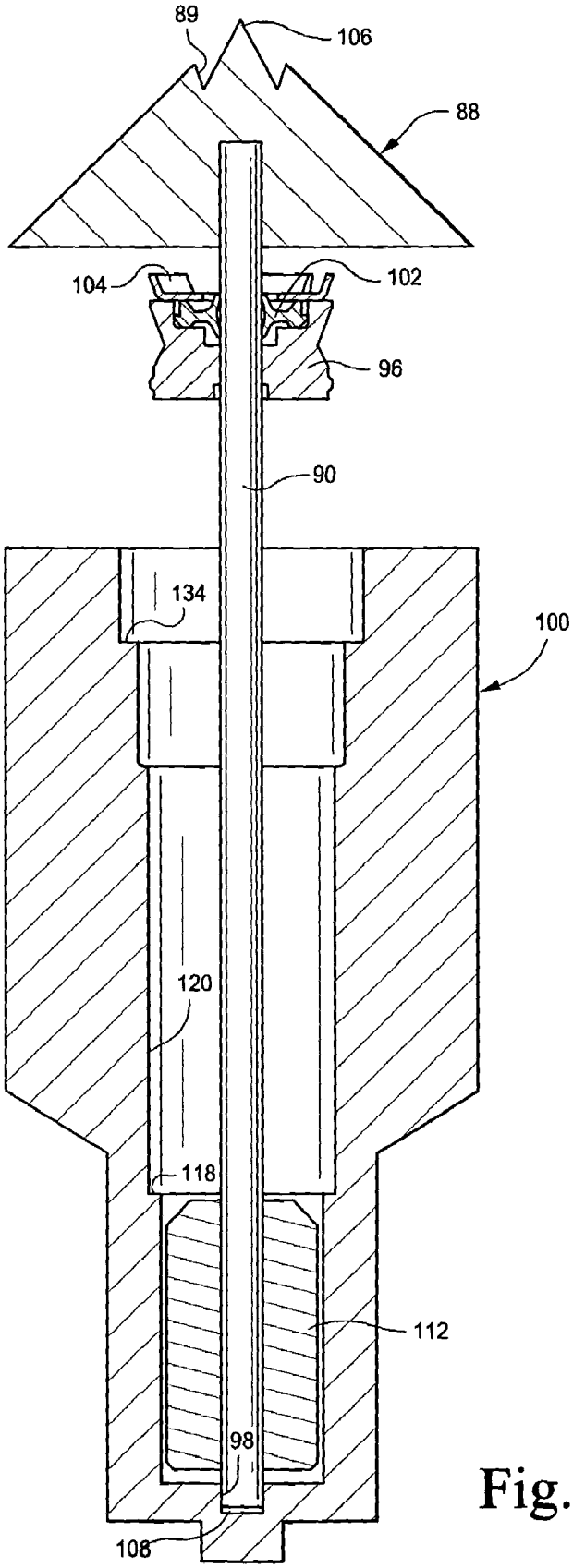
FIG. 7 is a section similar to FIG. 6 but showing only shaft, water distribution plate and second stator component.
Figure 8:
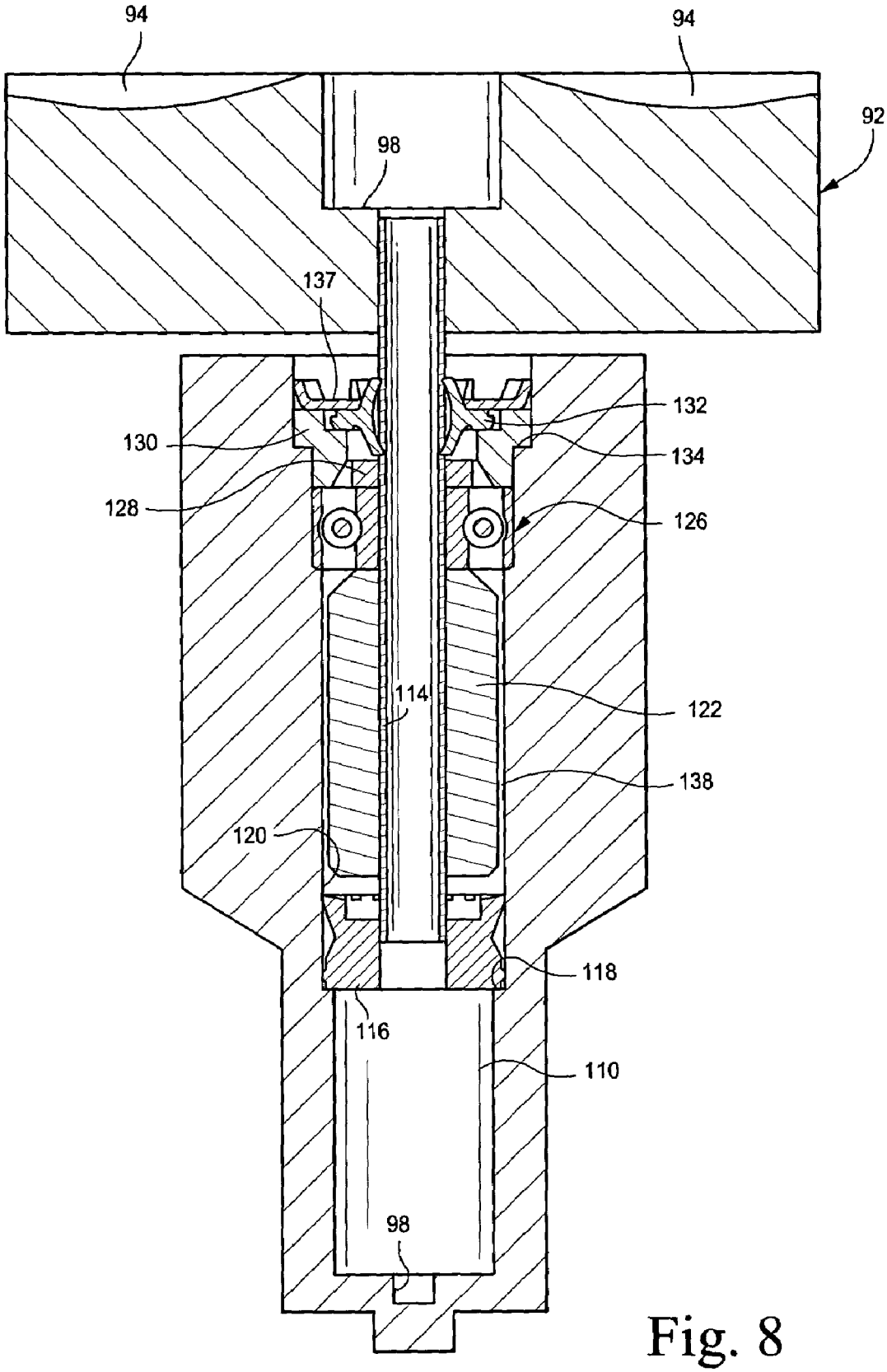
FIG. 8 is a section similar to FIG. 6 but showing only the sleeve, diffuser plate, and second stator component.
Figure 9:
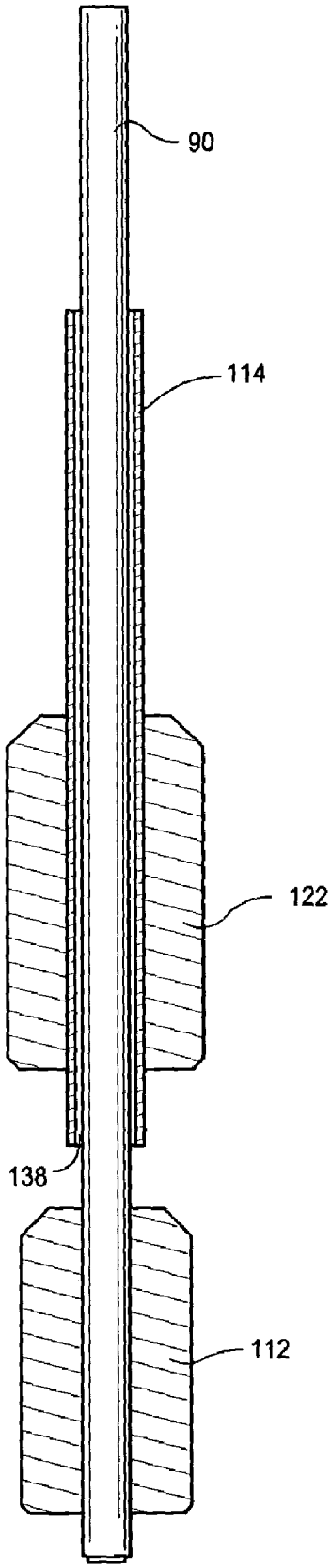
FIG. 9 is a front elevation of a shaft provided with a pair of stator elements as incorporated in the sprinkler shown in FIG. 6.
Figure 10:
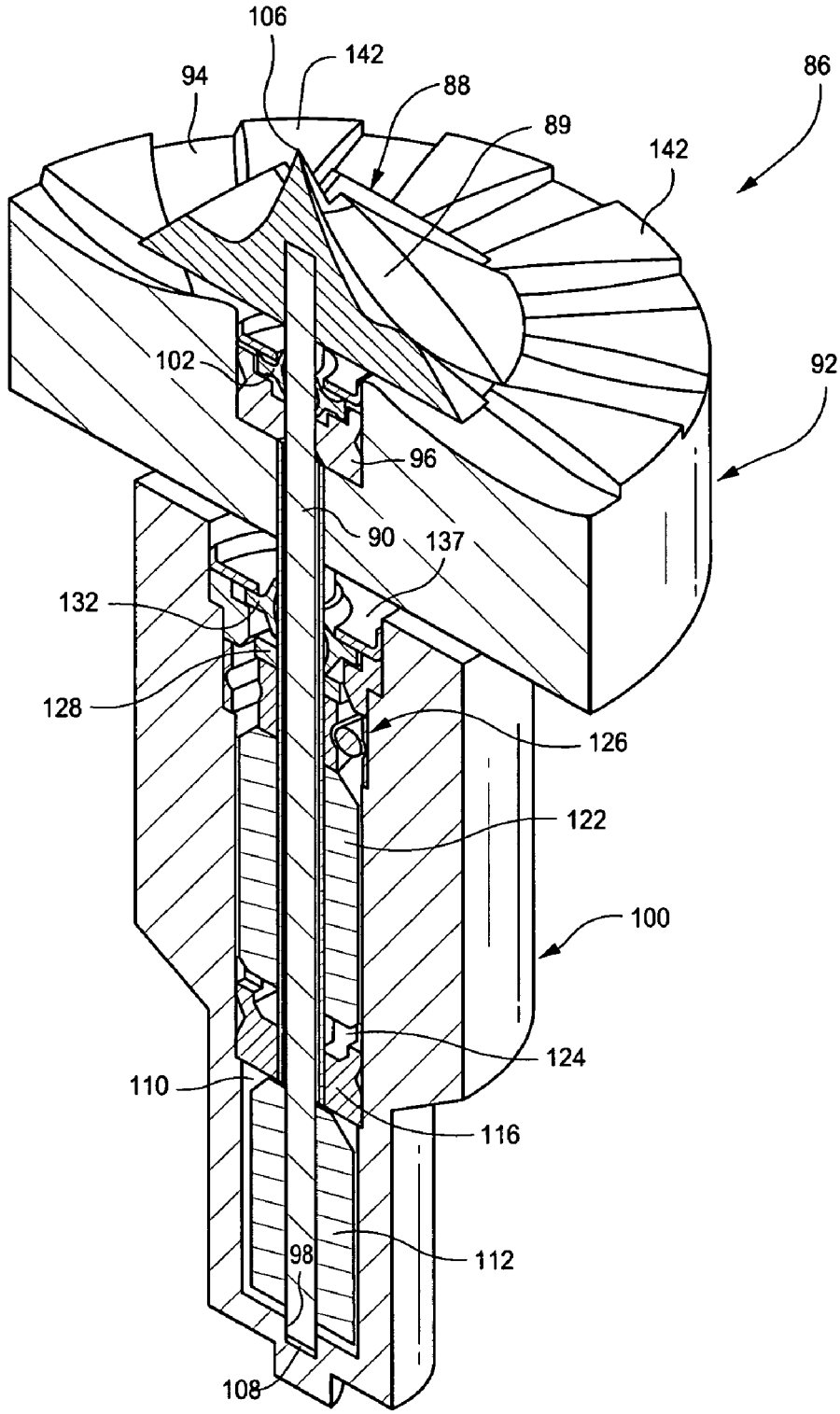
FIG. 10 is a sectioned perspective view of the water distribution plate and diffuser plate shown in FIG. 9.

A second embodiment of a combined water distribution plate/diffuser assembly 86 is shown in FIGS. 6-10. In this embodiment, a more sharply defined conically-shaped water distribution plate 88 formed with curved grooves 89 is fixed to one end of a shaft 90. A diffuser plate 92 provided with diffuser elements or grooves 94 is supported on the shaft via bearing 96 adjacent the water distribution plate, and the opposite end of the shaft 90 is received in a blind recess 98 at a remote end of a fixed housing 100, but so as to be able to rotate relative to the housing. Bearing 96 is seated on a shoulder 97 defined by a counterbore 100 in the plate 92. Bearing 96 supports a flexible double-lip seal 102 and both the bearing and lip seal are held in place by a retainer 104. In this instance, a nozzle (not shown) emits a single solid stream S that is located upstream of the water distribution plate 88, and the shaft 90 forms no part of, nor does it extend through, the nozzle supported in the sprinkler body as in the previously described embodiment. It will be appreciated, of course, that the configuration as shown in FIG. 6 (including the nozzle) may be inverted.

The grooves 89 (best seen in FIG. 10) in the water distribution plate 88 cause the plate 88 to rotate with the shaft, but here, the grooves continue to an apex 106 on which the solid stream S impinges and breaks up into secondary streams or stream components that flow through the grooves 94, causing rotation of the plate 92 and shaft 90.

As indicated above, the opposite end of shaft 90 is received in the blind recess 98, with a thrust bearing 108 interposed between the shaft end and the end face of the recess. The blind recess or bore 98 is counterbored to partially define a cavity 110 that receives a first substantially cylindrical rotor 112 fixed to the shaft 90.

A sleeve 114 receives the diffuser plate 92 in a press-fit relationship, the sleeve telescoped over the shaft 90 and extending from the diffuser plate 92 adjacent bearing 96, into the housing 100 where it terminates within a bearing 116 located adjacent the rotor 112. The bearing 116 is seated on a shoulder 118 formed by a counterbore 120. A second substantially cylindrical rotor 122 is fixed to the sleeve 114 and is located in a second chamber 124 substantially closed by the bearing 116 and a ball bearing 126 that also supports the sleeve 114 within the housing 100. A retainer 128 for the ball bearing 126, a seal support ring 130 and a flexible double-lip seal 132 are all mounted on the sleeve 114, with supporting ring 130 seated on shoulder 134 and lip seal 132 seated on ring shoulder 136. A retainer 137 holds the lip seal 132 in place. The second chamber 124 is also at least partially filled with viscous fluid so that the rotation speed of the diffuser plate 92 is slowed by the interaction of rotor 122 and the viscous fluid in the second chamber 124.

Note also that viscous fluid is present in the radial space 138 between the shaft 90 and sleeve 114. The fluid is available from the first chamber 110 that is in fluid communication with space 118 via bore 140 in the bearing 116.

The assembly 86 operates in much the same manner as the first-described embodiment. Specifically, water impinging on the plate 88 will cause that plate to rotate but at a reduced speed due to the viscous dampening or braking that results from the rotation of shaft 90 and rotor 112 in the first viscous chamber 110. The diffuser plate 92 will rotate at a different speed when struck by secondary streams from the grooves 89 by reason of the curvature of grooves 94 but also by reason of the fluid coupling established between the shaft 90 and sleeve 114 via the viscous fluid in space 138. As in the earlier-described embodiment, grooves 94 may or may not be curved, i.e., they may or may not serve as drive grooves. It will be understood that some of the secondary streams will also impinge on, and be diffused by, raised flats 142 circumferentially between the grooves 94 since the plate 88 rotates faster than the diffuser plate 92.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler comprising a stationary nozzle arranged to emit a stream of water directly to atmosphere, a water distribution plate and diffuser plate assembly located downstream of said nozzle, said assembly comprising a shaft mounted in a housing for rotation relative to the housing; a water distribution plate fixed to one end of said shaft, said water distribution plate formed with at least one drive groove adapted to receive the stream emitted to atmosphere by the nozzle and to rotate said water distribution plate and said shaft relative to said housing; a sleeve received over a portion of said shaft, said sleeve mounting a diffuser plate adjacent said water distribution plate, at one end of said sleeve; said shaft and said sleeve supported by plural bearings enabling said sleeve and said diffuser plate to rotate relative to said water distribution plate and said shaft; and wherein at least one of said shaft and said sleeve mounts a rotor located in a first chamber at least partially filled with a viscous fluid to thereby slow rotation of a respective one of said water distribution plate and said diffuser plate.

2. The sprinkler of claim 1 wherein said diffuser plate is formed with a plurality of diffuser grooves with flats between said grooves.

3. The sprinkler of claim 2 wherein said diffuser grooves are curved in a circumferential direction.

4. The sprinkler of claim 1 wherein a radial space between said shaft and said sleeve also contains said viscous fluid.

5. The sprinkler of claim 1 wherein said plural bearings include a pair of sleeve bearings in said housing and a shaft bearing in said diffuser plate.

6. The sprinkler of claim 5 and further comprising a seal engaged with said sleeve, supported at an open end of said housing.

7. The sprinkler of claim 5 wherein said plural bearings include a shaft bearing at a closed end, of said housing.

8. A sprinkler comprising a stationary nozzle arranged to emit a liquid stream to atmosphere, a water distribution plate and diffuser plate assembly located downstream of said nozzle, said assembly comprising a shaft mounted in a housing for rotation relative to the housing; a water distribution plate fixed to one end of said shaft, said water distribution plate formed with at least one drive groove adapted to receive the stream emitted to atmosphere by the nozzle and to rotate said water distribution plate and said shaft relative to said housing; a sleeve received over a portion of said shaft said sleeve mounting a diffuser plate adjacent said water distribution plate, at one end of said sleeve; said shaft and said sleeve supported by plural bearings enabling said sleeve and said diffuser plate to rotate relative to said water distribution plate and said shaft wherein at least one of said shaft and said sleeve mounts a rotor located in a first chamber at least partially filled with a viscous fluid, and wherein both said sleeve and said shaft mount said first and a second rotor, respectively, located within said first and a second chamber in said housing, said first and second chambers at least partially filled with said viscous fluid.

9. The sprinkler of claim 8 wherein one of said plural bearings separates said first and second chambers.

* * * * *